US012326153B2

(12) United States Patent
Pohler

(10) Patent No.: US 12,326,153 B2
(45) Date of Patent: Jun. 10, 2025

(54) SELF CLEANING CUTTER, CUTTING ASSEMBLY, AND PUMP

(71) Applicant: Liberty Pumps, Inc., Bergen, NY (US)

(72) Inventor: Donald M. Pohler, North Chili, NY (US)

(73) Assignee: Liberty Pumps, Inc., Bergen, NY (US)

( * ) Notice: Subject to any disclaimer, the term of this patent is extended or adjusted under 35 U.S.C. 154(b) by 0 days.

(21) Appl. No.: 18/386,313

(22) Filed: Nov. 2, 2023

(65) Prior Publication Data

US 2025/0146505 A1 May 8, 2025

(51) Int. Cl.
*F04D 29/22* (2006.01)
*F04D 7/04* (2006.01)

(52) U.S. Cl.
CPC ..... *F04D 29/2288* (2013.01)

(58) Field of Classification Search
CPC ..... F04D 29/2288; F04D 29/22; F04D 7/045; F04D 7/04; B02C 2018/164
See application file for complete search history.

(56) References Cited

U.S. PATENT DOCUMENTS 592,175 A * 10/1897 Sheely ..... A47J 43/1075 416/65
3,429,513 A * 2/1969 Gribble ..... B02C 18/0092 241/257.1
3,889,885 A * 6/1975 Couture ..... D21B 1/347 241/46.11
4,145,008 A * 3/1979 Wolford ..... B02C 18/0092 241/185.6
4,480,796 A * 11/1984 Paraskevas ..... D21B 1/347 241/46.11
5,456,580 A * 10/1995 Dorsch ..... B02C 18/0092 415/121.1
5,460,482 A * 10/1995 Dorsch ..... F04D 7/045 415/121.1
5,918,822 A * 7/1999 Sternby ..... D21B 1/347 241/46.11
5,927,624 A * 7/1999 Hughes ..... B02C 18/067 241/186.4
7,159,806 B1 1/2007 Ritsema
8,267,643 B2 * 9/2012 Wagner ..... F04D 29/2288 415/206
9,073,056 B2 * 7/2015 Abeln ..... B02C 18/18
10,316,846 B2 * 6/2019 Davis ..... F04D 29/4293
10,364,821 B2 * 7/2019 Pohler ..... F04D 29/2288
11,161,121 B2 11/2021 Brinkmann et al.
11,253,866 B2 2/2022 Backe
11,365,738 B2 6/2022 Ulliman
11,655,821 B2 5/2023 Vallen et al.
(Continued)

*Primary Examiner* — Woody A Lee, Jr.
*Assistant Examiner* — Joshua R Beebe
(74) *Attorney, Agent, or Firm* — John M. Hammond; Patent Innovations LLC

(57) ABSTRACT

A rotatable cutter, which may be used in a cutting assembly and in a grinder pump, is provided comprising at least a first cutting blade and a second cutting blade. Each of the first and the second cutting blades include a central region and a distal region. A protruding nub extends axially outwardly from the distal region of at least one of the first and second cutting blades. The rotatable cutter is engageable with a rotating drive shaft, which may also be engaged with an impeller of the pump.

15 Claims, 11 Drawing Sheets

(56) References Cited

U.S. PATENT DOCUMENTS

| | | | | |
|---|---|---|---|---|
| 2008/0054108 | A1* | 3/2008 | Matz | D21B 1/345<br>241/46.11 |
| 2013/0108411 | A1 | 5/2013 | Ciotola | |
| 2019/0321828 | A1 | 10/2019 | Backe | |

* cited by examiner

SELF CLEANING CUTTER, CUTTING ASSEMBLY, AND PUMP

BACKGROUND

Technical Field

Pumps for the transfer of liquids; more particularly, centrifugal pumps, and centrifugal grinding pumps; and cutters and cutting assemblies thereof.

Description of Related Art

A pump is a device used to transport liquid from a lower to a higher elevation, or from a vessel of lower pressure to a vessel of higher pressure, or to a state of low velocity to a state of high velocity. Generally, in transporting a liquid, a pump adds energy to the liquid. Typically, an electric motor or other suitable motor is used to spin an impeller or other liquid driver inside a volute casing, transferring energy to the liquid. In many instances, a pump is submerged in a pool and its discharge is connected to a pipe that is used to convey the liquid to a higher elevation. Although pumps have been known for millennia, and advances in the design and manufacturing of pumps have continued right up to the present, there remain opportunities for improvement in many aspects of pump design, such as efficiency, reliability, and manufacturing cost.

This applies to centrifugal pumps, and to grinder pumps. A grinder pump is a pump that reduces the size of solid objects suspended in the liquid. In a typical grinder pump, a cutting or grinding device is incorporated into the suction opening of the pump, which chops or reduces the size of solid objects as the pump moves the liquid. The design of the cutting/grinding device varies by manufacturer, but in essentially all centrifugal grinder pumps, the slurry from the cutting/grinding device is drawn from the cutting apparatus to the eye of an impeller.

SUMMARY

Under normal operation of a grinder pump, solid and semi-solid debris in the slurry is ground into small particles by a cutter that rotates with the pump impeller in a shearing motion against a cutter plate. The particles and carrier liquid then pass through orifices in the cutter plate, the impeller vanes, and volute casing and are discharged from the pump outlet. It has been found that when fibrous solid debris is present in the slurry to be pumped, instead of being chopped by the cutter, some of the fibrous material may accumulate near and around the rotating cutter. The fibrous material may become entangled or woven into a roughly toroidal shape somewhat similar to the interwoven fibers in some types of bird's nests.

When the accumulation of the fibers in a nest-like pattern becomes sufficiently large, the intertwined fibers may obstruct the flow of slurry to the pump. The flow of liquid though the cutter plate into the pump volute is restricted, and the intertwined fibers also act as a filter, blocking the flow of solid material to the cutter where it is chopped into particles. At some point due to this clogging by the intertwined fibers, the pump ceases pumping liquid, or is reduced in capacity enough to require an intervention. The pump and the process that it is being used for must be stopped, and the intertwined fiber obstruction must be removed. This interruption is undesirable in terms of process cost, schedule, and safety.

It has been discovered that a cutter having an external protrusion on at least one of the blades of the cutter is effective in preventing the formation of an obstructive "nest" of fibers during operation of the pump. More particularly, in accordance with the present disclosure, a rotatable cutter is provided comprising at least a first cutting blade and a second cutting blade, each of the first and the second cutting blades including a central region and a distal region, and a protruding nub extending axially outwardly from the distal region of at least one of the first and second cutting blades. The rotatable cutter is engageable with a rotating drive shaft, which may also be engaged with an impeller of the pump. The protruding nub may have a cylindrical shape, and oblong shape, a curvilinear shape, or another shape effective in preventing the formation of an obstructive nest of fibers during operation of the pump Also according to the present disclosure, a cutting assembly for size reduction of solids in a liquid to be pumped is provided comprising a rotatable drive shaft, a rotatable cutter engaged with the rotating drive shaft, and a plate cutter. The rotatable cutter is comprised of at least a first cutting blade and a second cutting blade. Each of the first and said second cutting blades includes a planar inner surface coplanar with each other, a central region and a distal region, and a protruding nub extending axially outwardly from the distal region of at least one of the first and second cutting blades. The plate cutter is comprised of an outer cutter surface contiguous with the planar inner surfaces of the blades of the rotatable cutter.

Also according to the present disclosure, a grinder pump is provided comprising a pump volute enclosing a pump impeller, and a cutting assembly for size reduction of solids in a liquid to be pumped as set forth above.

BRIEF DESCRIPTION OF THE DRAWINGS

The present disclosure will be provided with reference to the following drawings, in which like numerals refer to like elements, and in which.

Figure 1:
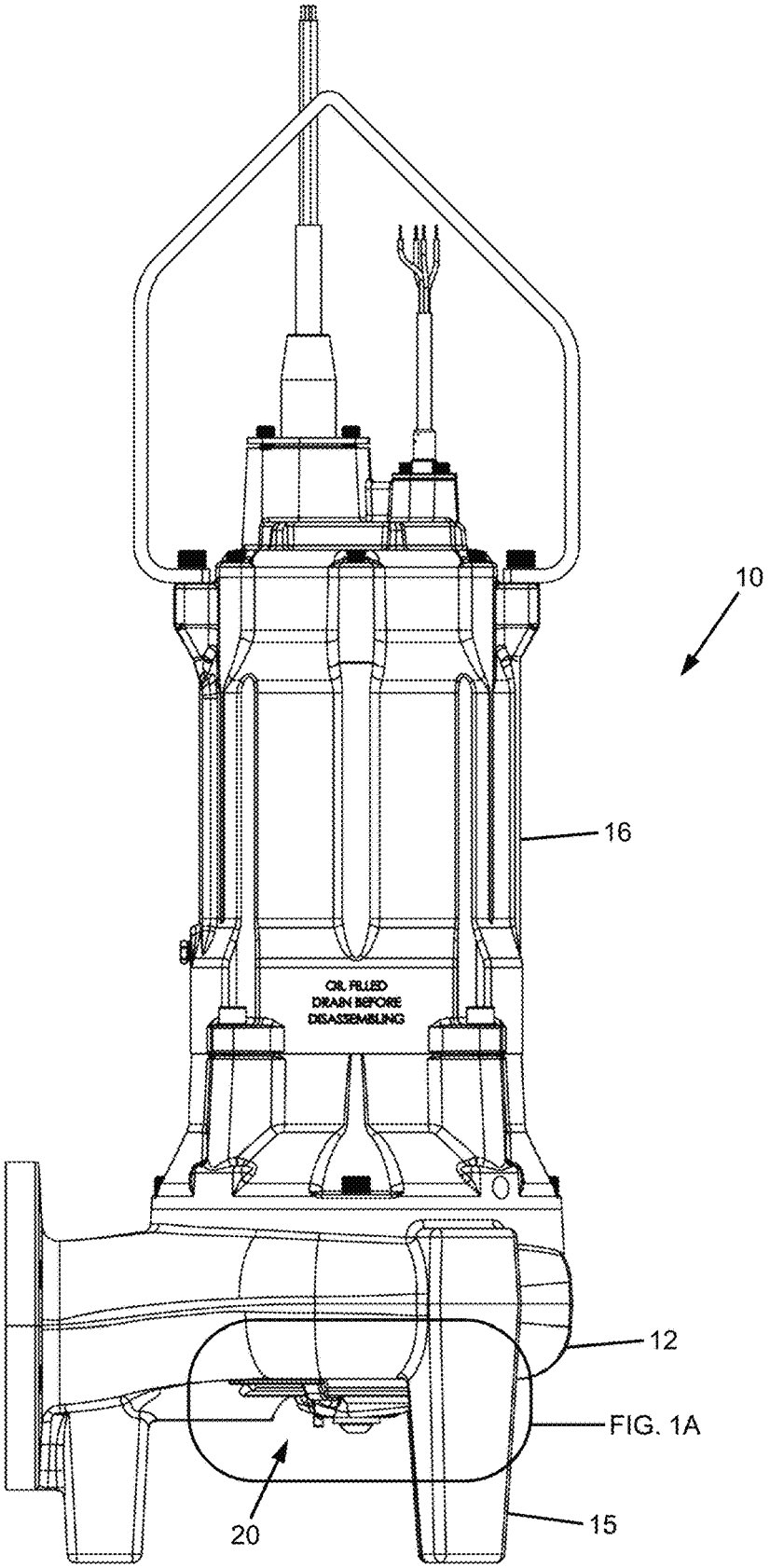
FIG. 1 is a side elevation view of a grinder pump of the present disclosure.
Figure 1A:
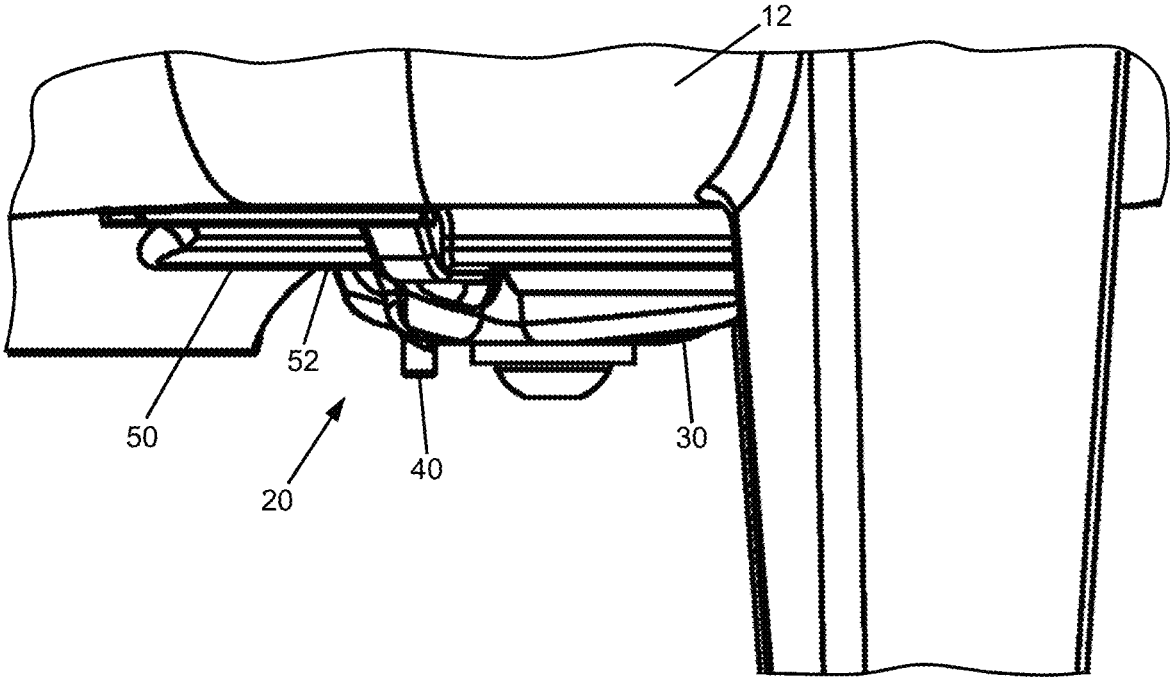
FIG. 1A is a detailed side elevation view of a cutting assembly of the pump of FIG. 1.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present disclosure, reference is made to the drawings. In the drawings, like reference numerals have been used throughout to designate identical elements. The drawings are to be considered exemplary, and are for purposes of illustration only. The dimensions, positions, order and relative sizes reflected in the drawings attached hereto may vary.

In the following disclosure, the present cutter invention is described in the context of its use as a cutter in a grinder pump. However, it is not to be construed as being limited only to use in size reduction in the pumping of liquids with entrained solids. The instant cutter invention is adaptable to any use in which size reduction is desirable to be provided from a rotating cutter. Additionally, the following description of a cutting assembly and grinder pump may identify certain components with the adjectives "top," "upper," "bottom," "lower," "left," "right," etc. These adjectives are provided in the context of use of the grinder pump and in the context of the orientation of the drawings, which is arbitrary. The description is not to be construed as limiting the cutter, cutting assembly, and grinder pump to use in a particular spatial orientation. These elements and devices may be used in orientations other than those shown and described herein.

It is also to be understood that any connection references used herein (e.g., attached, coupled, connected, and joined) are to be construed broadly and may include intermediate members between a collection of elements and relative movement between elements unless otherwise indicated. As such, connection references do not necessarily imply that two elements are directly connected and in fixed relation to each other.

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the present disclosure.

The terms "about" and "substantially" are used herein with respect to measurable values and ranges due to expected variations known to those skilled in the art (e.g., limitations and variabilities in measurements).

For purposes of this disclosure, the conjunction "or" is to be construed inclusively (e.g., "a wrench or a screwdriver" would be interpreted as "a wrench, or a screwdriver, or both"; e.g., "a wrench, a screwdriver, or a hammer" would be interpreted as "a wrench, or a screwdriver, or a hammer, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives.

Figure 2A:
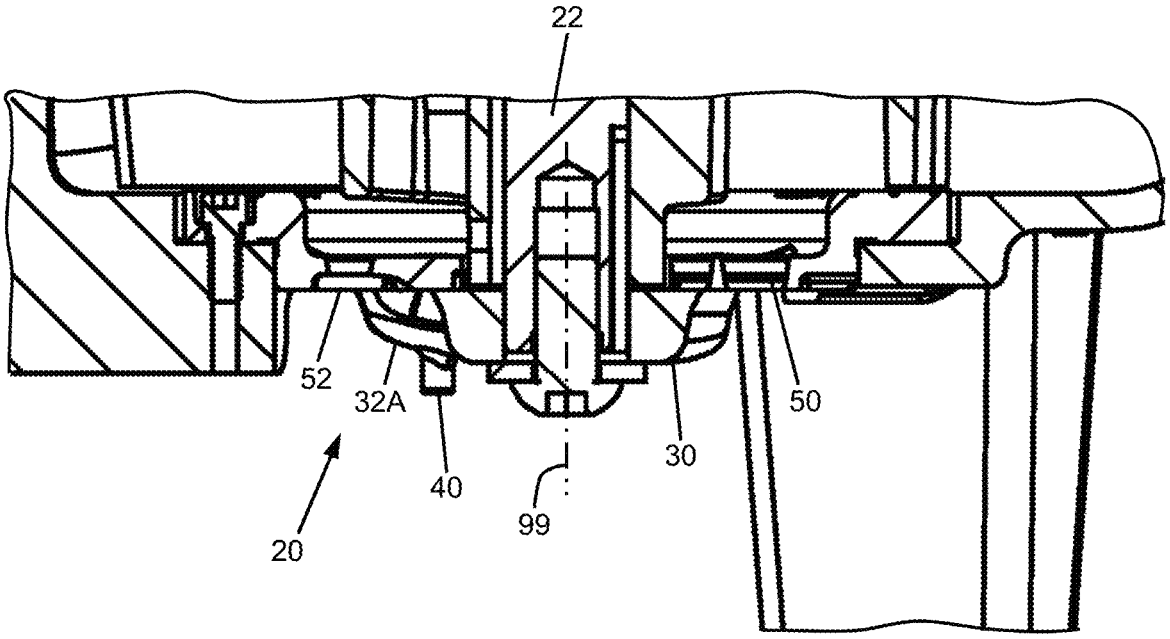
FIG. 2A is a detailed cross-sectional view of a cutting assembly of the pump of FIG. 1.
Figure 2:
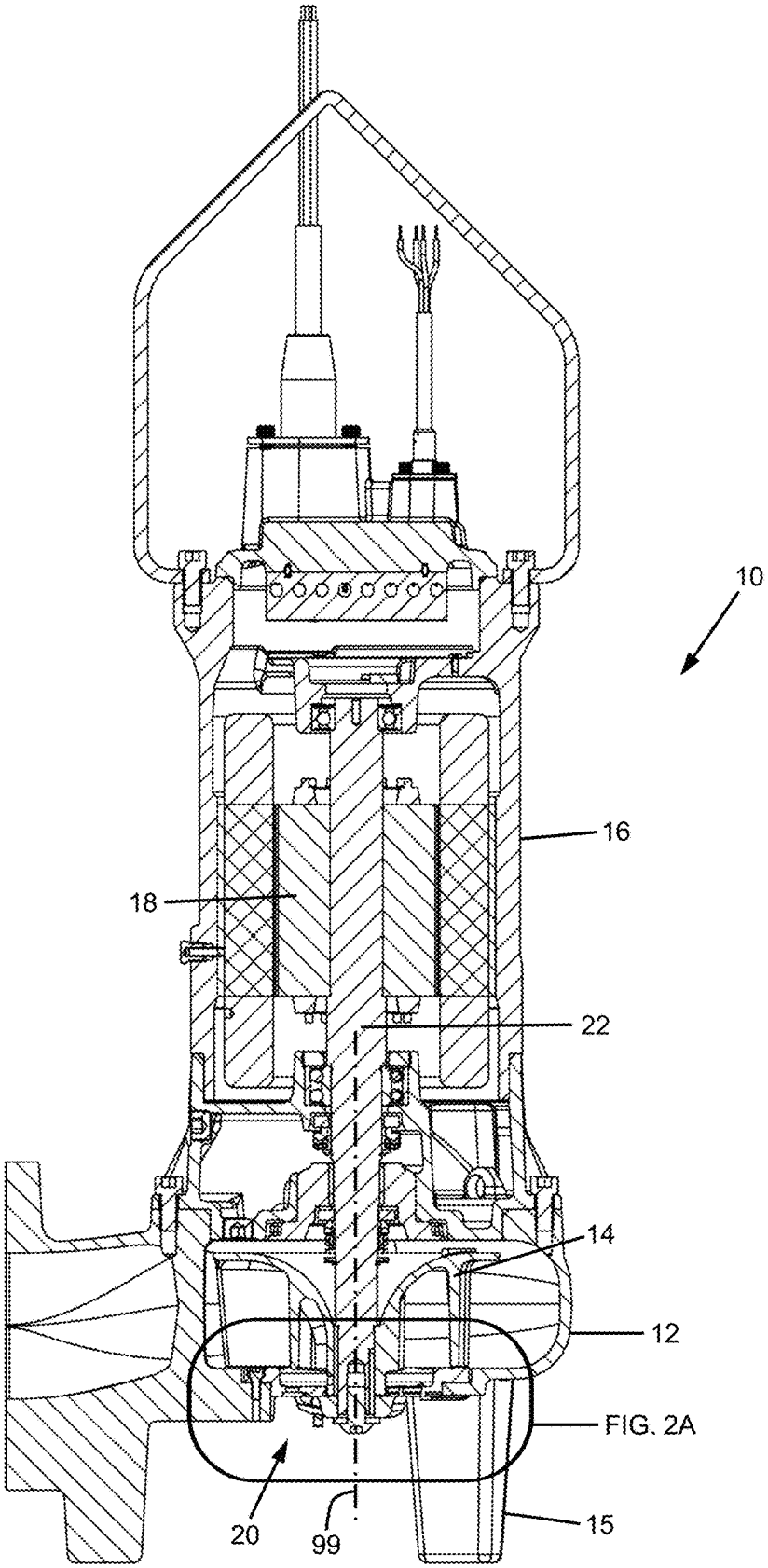
FIG. 2 is a cross-sectional view of the pump of FIG. 1.
Figure 3:
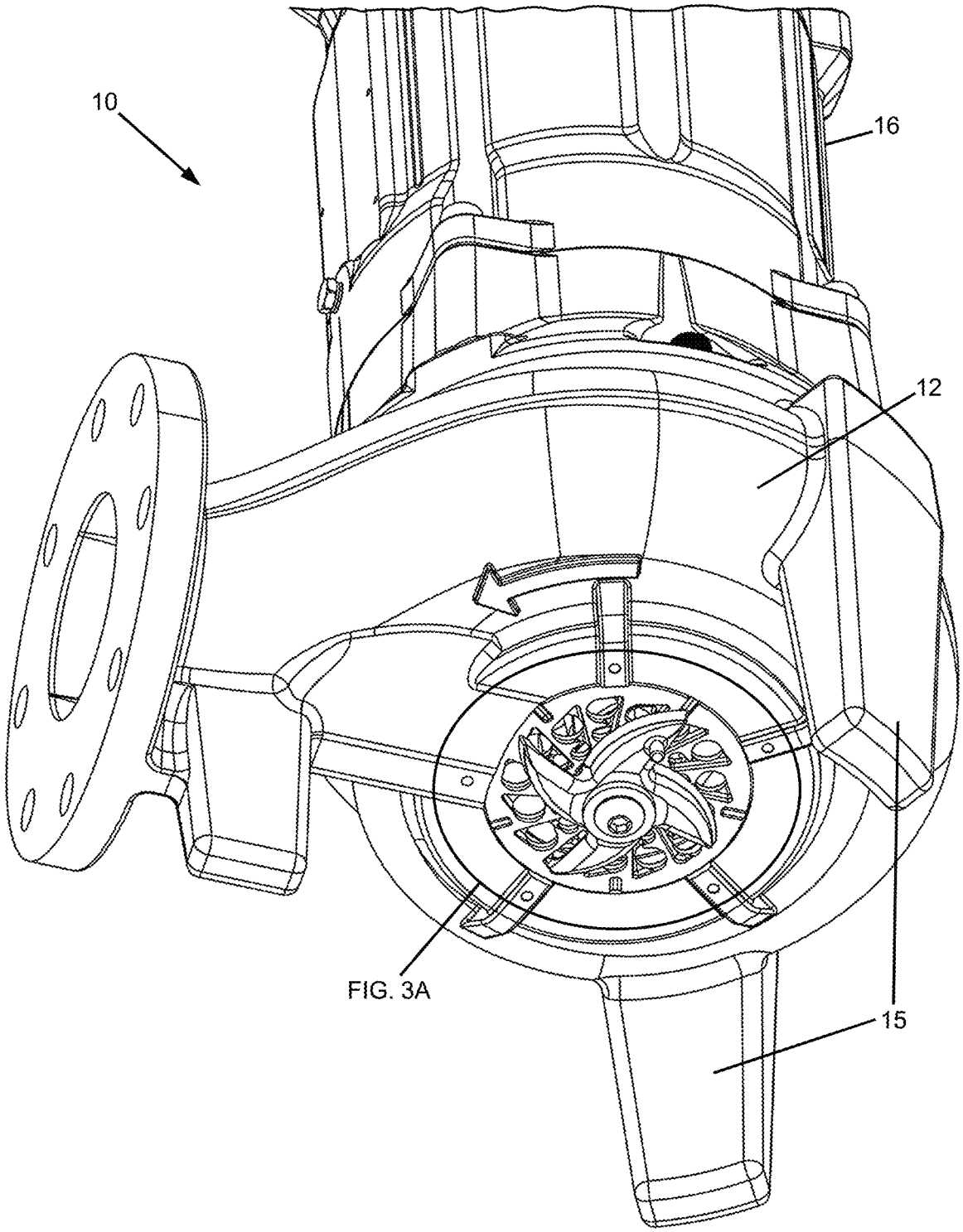
FIG. 3 is a lower perspective view of the grinder pump of FIG. 1 looking upwardly and showing an exemplary cutter and cutting assembly of the present disclosure.
Figure 3A:
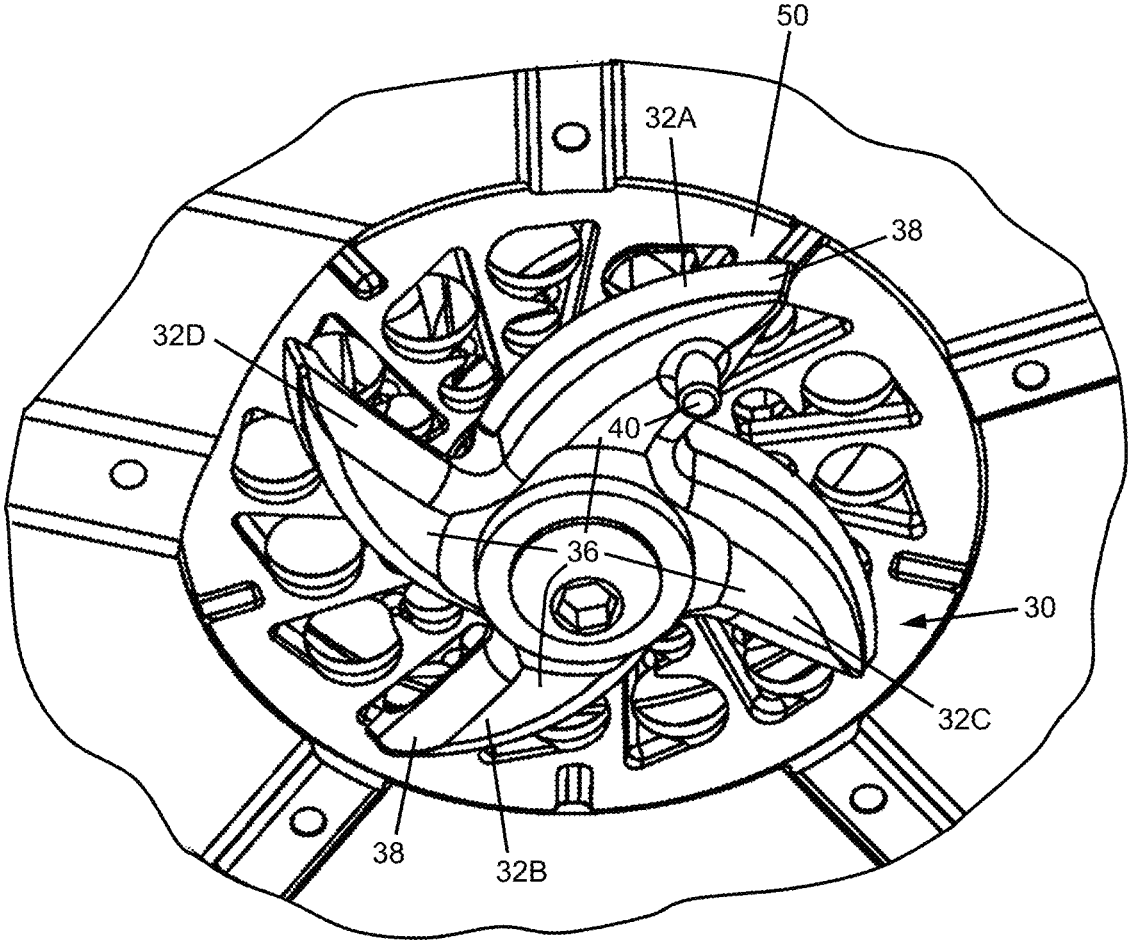
FIG. 3A is a detailed lower perspective view of the exemplary cutter and cutting assembly of the present disclosure.

Referring now to FIGS. 1-3, a grinder pump 10 is provided comprising a pump volute 12 enclosing a pump impeller 14, and a cutting assembly 20 for size reduction of solids in a liquid to be pumped. The pump 10 may be further comprised of a motor housing 16, and a motor 18 which drives a rotatable shaft 22. The impeller 14 of the pump 10 is operatively connected to the shaft 22. In general, the pump 10 may be similar to the pumps disclosed in commonly owned U.S. Pat. Nos. 7,159,806 and 10,267,312, the disclosures of which are incorporated herein by reference.

Referring also to FIGS. 3A-4C, the cutting assembly 20 may be comprised of the rotatable drive shaft 22; a rotatable cutter 30 engaged with the rotating drive shaft 22, and a plate cutter 50. The rotatable cutter 30 is comprised of at least a first cutting blade 32A and a second cutting blade 32B. In the exemplary pump 10 and cutting assembly 20 of FIGS. 1-3A, the cutter 30 is comprised of four blades 32A-32D. Each of the cutting blades 32A-32D includes a planar inner surface 34; the planar inner surfaces 34 are coplanar with each other. Each of the cutting blades 32A-32D includes a central region 36 and a distal region 38. The plate cutter 50 is comprised of an outer cutter surface 52 contiguous with the planar inner surfaces 34 of the blades 32A-32D of the rotatable cutter 30. Referring in particular to FIGS. 3A and 4A-4C, the cutter is further comprised of a protruding nub 40 extending axially outwardly from the distal region 38 of at least one of the cutting blades 32A.

Figure 5A:
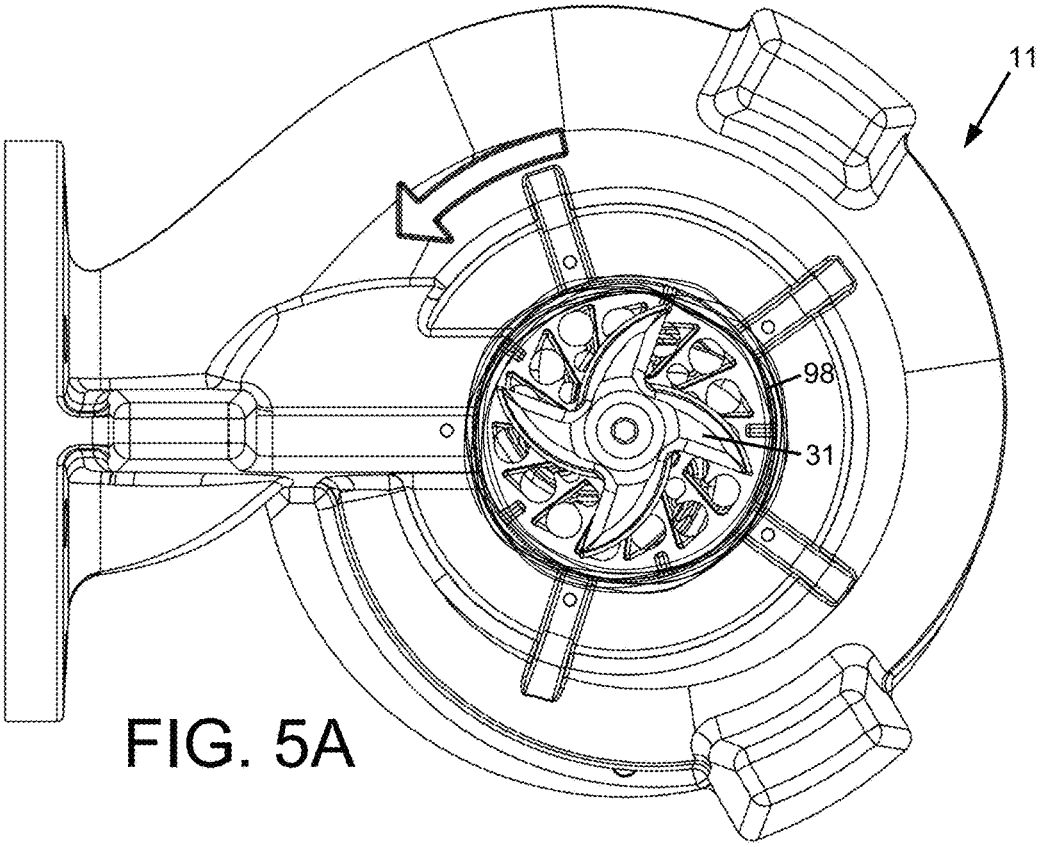
FIG. 5A is a lower plan view of a cutting assembly lacking features of a cutter of the present disclosure.

It is noted that under certain circumstances in which entrained solids are present in the liquid to be pumped, such as in a sewage environment, the entrained solids may vary widely. These different materials, and fibrous materials in particular, tend to tangle together to form intertwined nest-like bodies. Through experimentation, the applicant has observed that these bodies move with the cutter 30 in a circular way as to roll up layer upon layer, building an increasingly large circular mass under the cutter of the grinder pump 10. Referring to FIG. 5A, such a "nest-like' mass 98 is shown at least partially formed around a cutter 31 of a pump 11. The cutter 31 of pump 11 lacks a protruding nub described above. The wraps of this mass tend to become tighter and tighter, and may have a profile that matches that of the inlet of the pump 11. Eventually the mass builds and stops turning and clogs the pump 11. In order to clear the pump 11, manual intervention may be required.

Figure 5B:
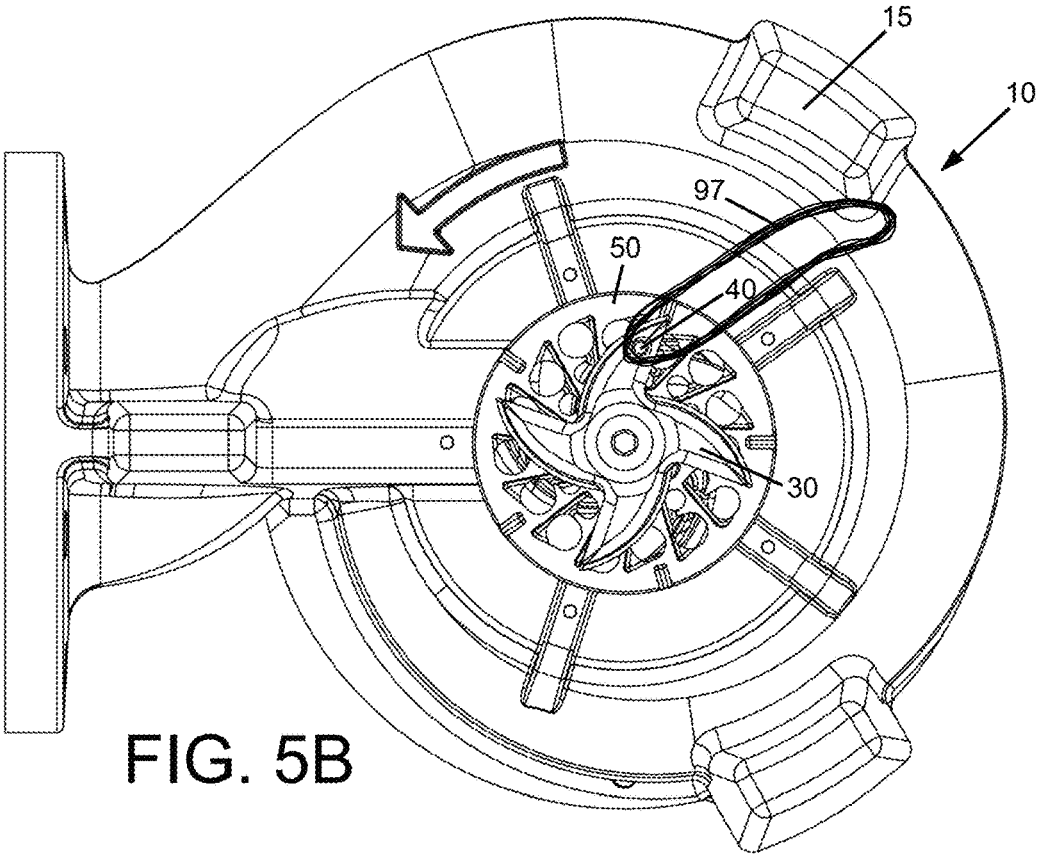
FIG. 5B is a lower plan view of a cutting assembly including a cutter of the present disclosure.

It has been observed that often the wrapping of fibers is around a central axis of the pump shaft 22. It has been discovered that the provision of a protruding nub 40 is beneficial in preventing the formation of nest-like bodies of fibers, or in causing them to break up. In some cases, providing the protruding nub 40 on one blade 32A of the cutter 30 at least an inch from the central axis 99 of the pump shaft 22 is effective in preventing such formation. It has been further observed that in some cases, the fibrous mass may encircle the nub 40 instead of forming around the central axis 99 of the pump 10. In such cases, the fibrous mass is offset from the central axis 99 of the pump 10. Referring to FIG. 5B, at some point the fibrous mass 97 may strike a stationary object such as the leg 15 of the pump. This action moves the mass 97 radially. As the pump 10 continues to operate, the fibrous nest-like mass 97 is pulled back toward the cutter 30 and is effectively chopped and sucked through the pump 10 as desired. In that manner, the wrapping of fibrous material into the nest-like mass 98 of FIG. 5A is prevented, thereby keeping the inlet of the pump 10 open and free of obstruction. The operation of the grinder pump 10 is thus maintained.

The protruding nub 40 of the rotatable cutter 30 may be provided in different configurations. FIGS. 6A-9C depict four cutters 30 having protruding nubs of various exemplary shapes and sizes.

Figure 4A:
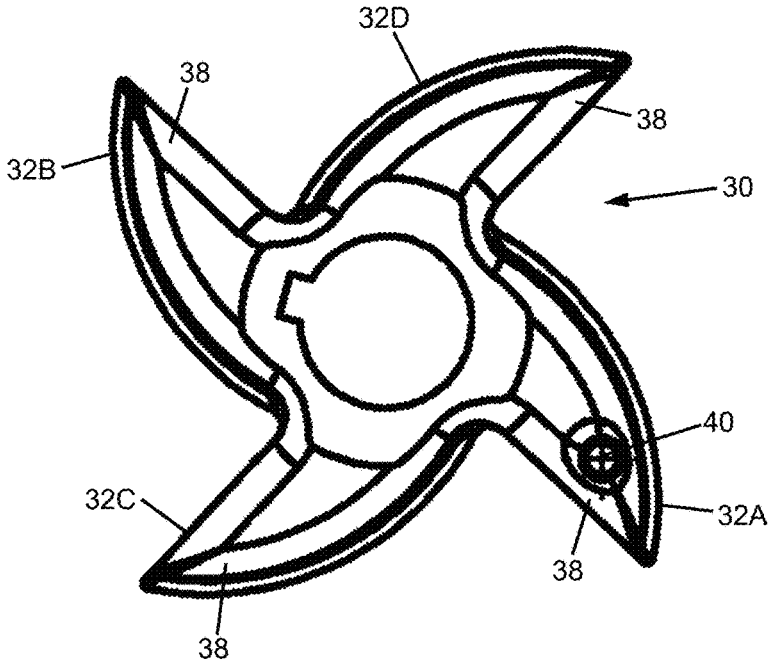
FIG. 4A is an external plan view of a cutter of the present disclosure.
Figure 4B:
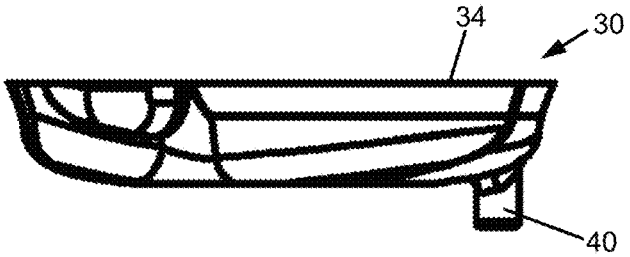
FIG. 4B is a side elevation view of the cutter of FIG. 4A.
Figure 4C:
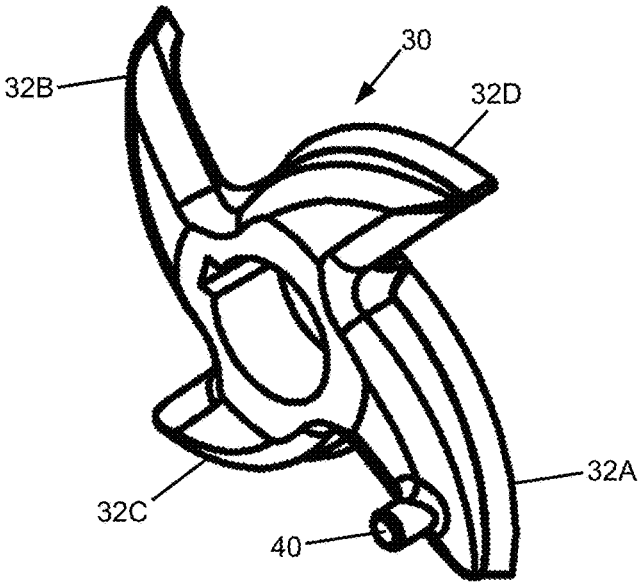
FIG. 4C is a perspective view of the cutter of FIG. 4A.
Figure 6A:
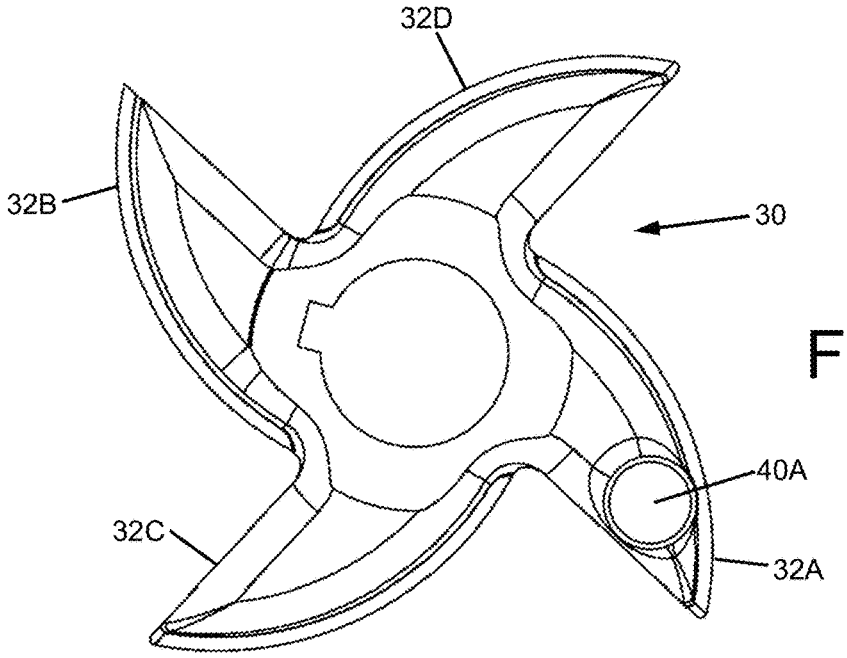
FIGS. 6A-6C are plan, side elevation, and perspective views, respectively, of a first alternative cutter of the present disclosure.
Figure 6B:
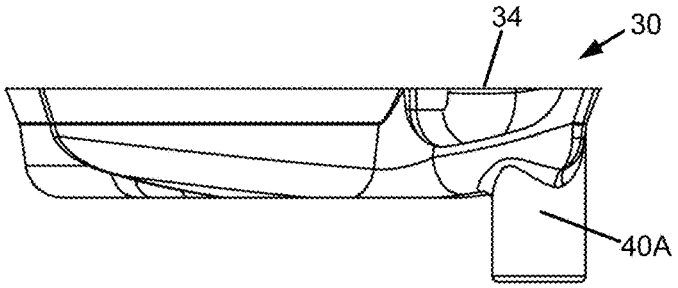
Figure 6C:
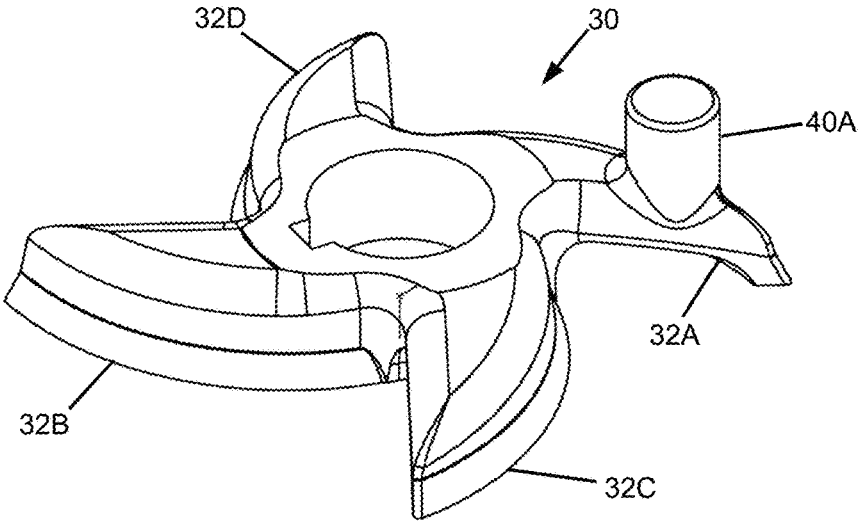

FIGS. 6A-6C depict a cutter 30 having a protruding nub 40A that is larger in diameter, and extends further axially from the cutting blade 32A, as compared to the nub 40 of the cutter 30 of FIGS. 4A-4C.

Figure 7A:
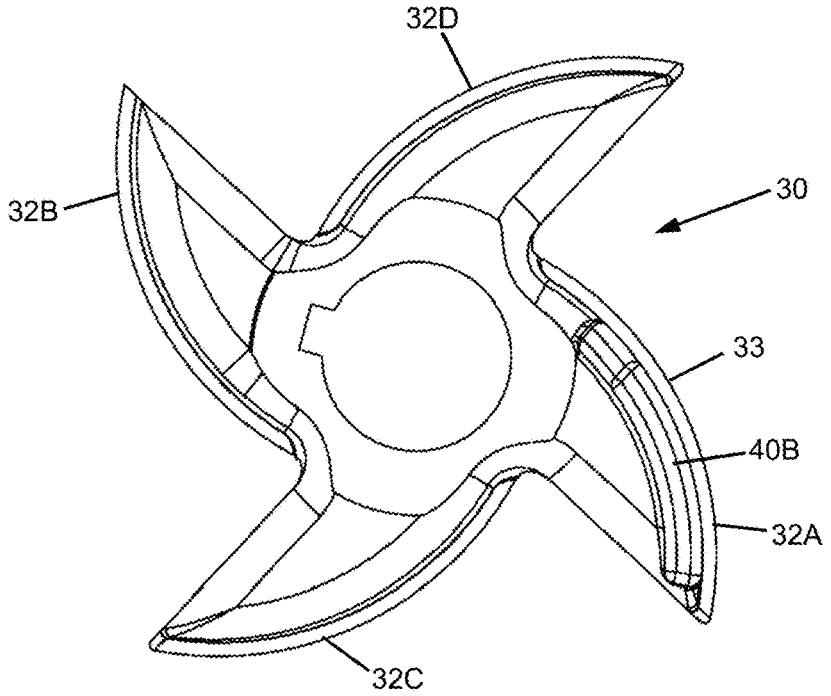
FIGS. 7A-7C are plan, side elevation, and perspective views, respectively, of a second alternative cutter of the present disclosure.
Figure 7B:
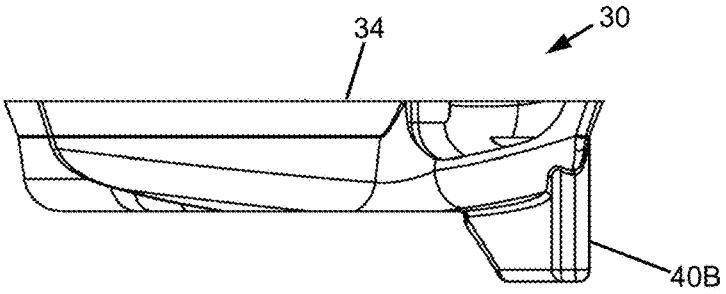
Figure 7C:
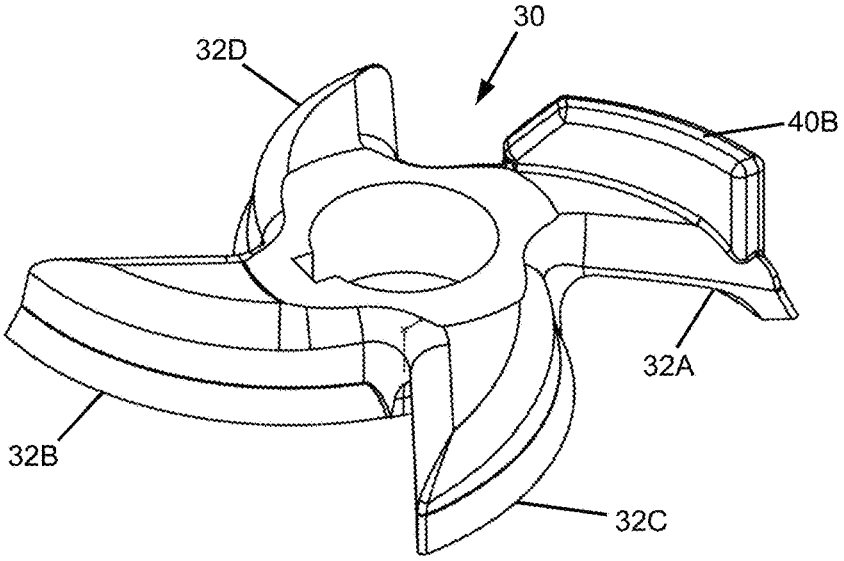

FIGS. 7A-7C depict a cutter 30 having a protruding nub 40B that is formed with a curvilinear shape, which may follow the contour of the forward edge 33 of the cutting blade 32A.

Figure 8A:
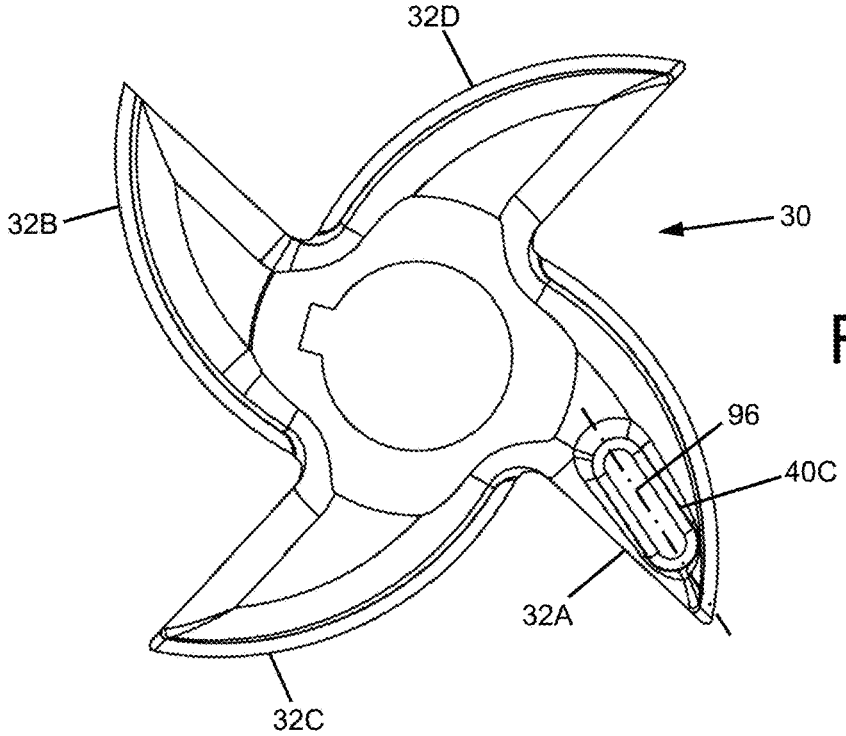
FIGS. 8A-8C are plan, side elevation, and perspective views, respectively, of a third alternative cutter of the present disclosure.
Figure 8B:
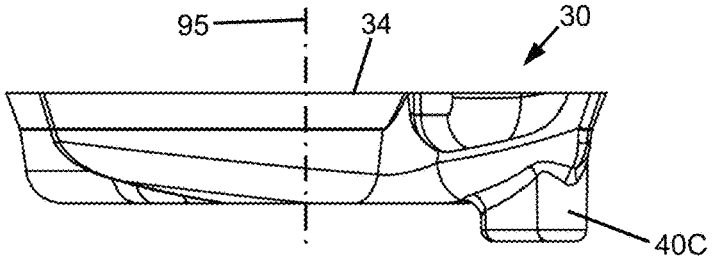
Figure 8C:
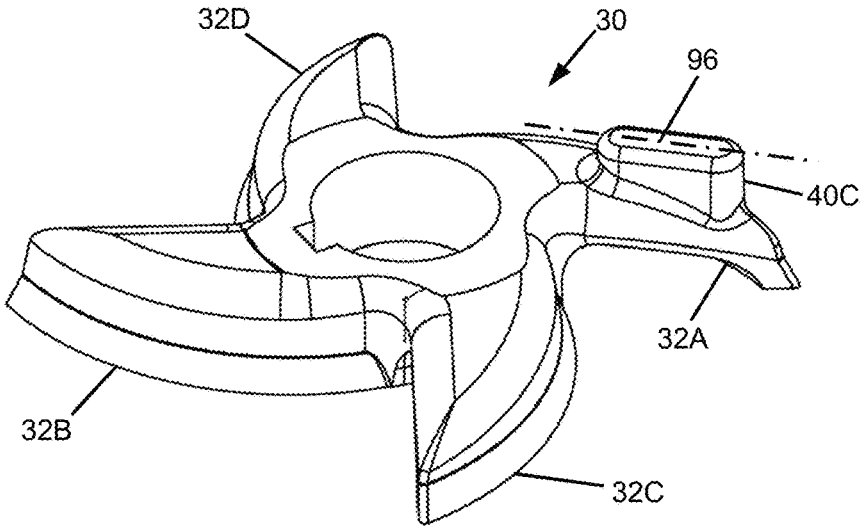

FIGS. 8A-8C depict a cutter 30 having a protruding nub 40C that has an oblong shape. The major axis 96 of the nub 40C may extend radially outwardly, i.e., substantially perpendicular to the direction of cutter blade motion during rotation of the cutter 30 around a central axis 95 of the cutter 30.

Figure 9A:
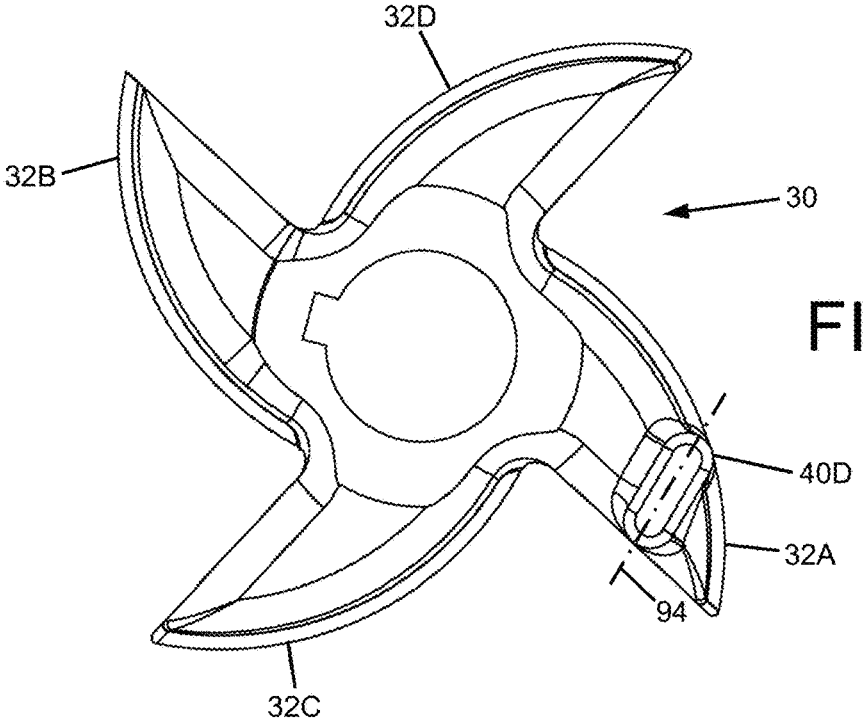
FIGS. 9A-9C are plan, side elevation, and perspective views, respectively, of a fourth alternative cutter of the present disclosure.
Figure 9B:
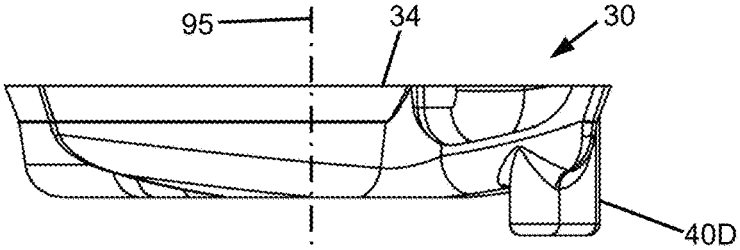
Figure 9C:
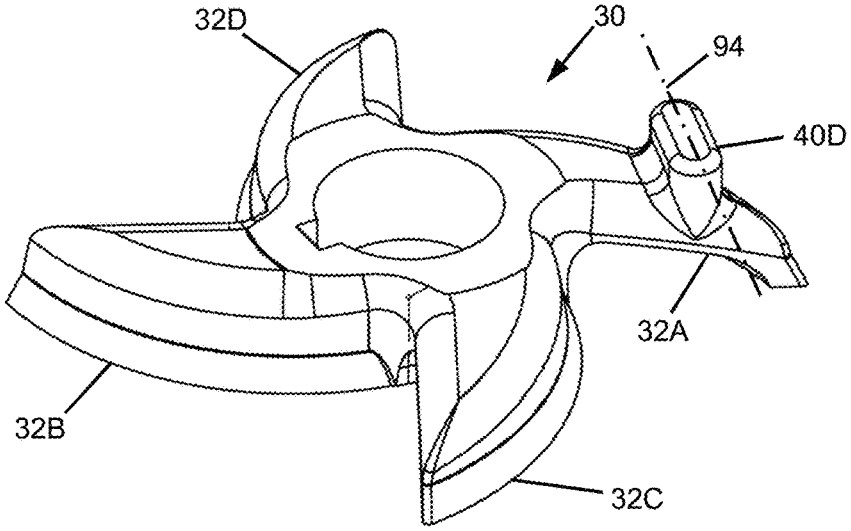

FIGS. 9A-9C depict a cutter 30 having a protruding nub 40D that also has an oblong shape. The major axis 94 of the nub 40D may extend circumferentially, i.e., in the direction of cutter blade motion during rotation of the cutter 30 around a central axis 95 of the cutter 30.

It is further noted that the cutters 30 of FIGS. 4A-4C, and 6A-9C may be comprised of a cutter blade 32B opposed to cutter blade 32A that includes protruding nub 40, wherein cutter blade 32B is formed with a greater thickness and/or greater length than those of cutter 32A. The greater thickness and/or greater length are chosen such that the cutter 30 is balanced and capable of steady vibration-free rotation.

It is therefore apparent that there has been provided, in accordance with the present disclosure, a cutter, cutting assembly, and grinder pump. The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

I claim:

1. A cutting assembly comprising:

a) a rotatable drive shaft;

b) a rotatable cutter engaged with the rotatable drive shaft and comprised of at least a first cutting blade and a second cutting blade, each of the first and the second cutting blades including a planar inner surface coplanar with each other, a central region and a distal region, the rotatable cutter further comprised of a single protruding nub extending axially outwardly from the distal region of one of the first and second cutting blades and including a radially outermost edge terminating short of the distal end of that one of the first and second cutting blades; and c) a plate cutter comprised of an outer cutter surface contiguous with the planar inner surfaces of the blades of the rotatable cutter.

2. The cutting assembly of claim 1, wherein the single protruding nub of the rotatable cutter is of a cylindrical shape.

3. The rotatable cutter of claim 1, wherein the single protruding nub of the rotatable cutter is of an oblong shape.

4. The rotatable cutter of claim 1, wherein the single protruding nub of the rotatable cutter is of a curvilinear shape.

5. A grinder pump comprising a pump volute enclosing a pump impeller, and a cutting assembly for size reduction of solids in a liquid to be pumped, the cutting assembly comprising:

a) a rotatable drive shaft;

b) a rotatable cutter engaged with the rotatable drive shaft and comprised of at least a first cutting blade and a second cutting blade, each of the first and the second cutting blades including a planar inner surface coplanar with each other, a central region and a distal region, the rotatable cutter further comprised of a single protruding nub extending axially outwardly from the distal region of one of the first and second cutting blades and including a radially outermost edge terminating short of the distal end of that one of the first and second cutting blades; and c) a plate cutter comprised of an outer cutter surface contiguous with the planar inner surfaces of the blades of the rotatable cutter.

6. The grinder pump of claim 5, wherein the single protruding nub of the rotatable cutter is of a cylindrical shape.

7. The grinder pump of claim 5, wherein the single protruding nub of the rotatable cutter is of an oblong shape.

8. The grinder pump of claim 5, wherein the single protruding nub of the rotatable cutter is of a curvilinear shape.

9. A rotatable cutter engageable with a rotating drive shaft and comprised of:

a) a first cutting blade and a second cutting blade, each of the first and the second cutting blades comprising a distal region, and each of the first and the second cutting blades extending radially outwardly from an axis of rotation of the rotating drive shaft to a distal end;

b) a single protruding nub extending axially outwardly from the distal region of one of the first and second cutting blades and including a radially outermost edge terminating short of the distal end of that one of the first and second cutting blades.

10. The rotatable cutter of claim 9, wherein the single protruding nub is of a cylindrical shape.

11. The rotatable cutter of claim 9, wherein the single protruding nub is of an oblong shape.

12. The rotatable cutter of claim 11, wherein the single protruding nub extends radially outwardly with respect to a central axis of rotation of the cutter.

13. The rotatable cutter of claim 11, wherein the single protruding nub extends circumferentially with respect to a central axis of rotation of the cutter.

14. The rotatable cutter of claim 9, wherein the single protruding nub is of a curvilinear shape.

15. The rotatable cutter of claim 14, wherein curvilinear shape of the single protruding nub corresponds to the shape of a forward edge of the first cutting blade.

* * * * *